US006128460A

United States Patent [19]

Ito et al.

[11] Patent Number: 6,128,460

[45] Date of Patent: Oct. 3, 2000

[54] IMAGE FORMING SYSTEM FOR CONVEYING RECORDING MATERIAL

[75] Inventors: Yoshikuni Ito, Yokohama; Yoichi Kimura, Numazu; Haruhiko Omata, Susono, all of Japan

[73] Assignee: Canon Kabushiki Kaisha, Tokyo, Japan

[21] Appl. No.: 09/160,088

[22] Filed: Sep. 25, 1998

[30] Foreign Application Priority Data

Sep. 30, 1997 [JP] Japan ..... 9-282826
Sep. 11, 1998 [JP] Japan ..... 10-258234

[51] Int. Cl.[7] ..... G03G 15/01

[52] U.S. Cl. ..... 399/303

[58] Field of Search ..... 399/299, 302, 399/303, 315, 298, 300; 492/53

[56] References Cited

U.S. PATENT DOCUMENTS 5,469,248 11/1995 Fujiwara et al. ..... 399/298
5,619,310 4/1997 Todome ..... 399/381
5,659,842 8/1997 Hasegawa et al. ..... 399/66
5,778,291 7/1998 Okubo et al. ..... 399/302
5,794,110 8/1998 Kasai et al. ..... 399/299

*Primary Examiner*—William Royer
*Assistant Examiner*—William A. Noe
*Attorney, Agent, or Firm*—Fitzpatrick, Cella, Harper & Scinto

[57] ABSTRACT

An image forming apparatus for conveying recording material. The image forming apparatus includes an image bearing member for bearing a toner image, a recording material convey belt for bearing and conveying a recording material, a roller for supporting the recording material convey belt and having an insulation layer, and an electricity removal device for removing electricity from the insulation layer. The toner image on the image bearing member is electrostatically transferred onto the recording material borne by the recording material convey belt, and the roller supports the recording material convey belt at a separation position where the recording material is separated from the recording material convey belt.

23 Claims, 8 Drawing Sheets

IMAGE FORMING SYSTEM FOR CONVEYING RECORDING MATERIAL

BACKGROUND OF THE INVENTION

1. Field of the Invention

The present invention relates to an image forming apparatus of electrophotographic type for forming an image, such as a copying machine, a printer, a facsimile and the like.

2. Related Background Art

In the past, there have been proposed various image forming apparatuses which include a plurality of image forming portions and in which different color toner images are formed in the respective image forming portions and are successively transferred onto a single recording material in a superimposed fashion to thereby form a color image. In such a circumstance, image forming apparatuses of electrophotographic type utilizing an endless recording material bearing member have been used for high speed recording.

Explaining an example of the image forming apparatus with reference of FIG. 11, first, second, third and fourth image forming portions Pa, Pb, Pc and Pd are disposed side by side within a main body of the apparatus, and different color toner images are formed through processes (latent image formation, development and transferring).

The image forming portions Pa, Pb, Pc and Pd include exclusive image bearing member (in this example, electrophotographic photosensitive drums 3*a*, 3*b*, 3*c* and 3*d*) and different color toner images are formed on the respective photosensitive drums 3*a* to 3*d*. A transfer belt 200 is disposed adjacent to the photosensitive drums 3*a*, 3*b*, 3*c* and 3*d*, so that the different color toner images formed on the respective photosensitive drums 3*a*, 3*b*, 3*c* and 3*d* are successively transferred onto a recording material P born on the transfer belt 200 in a superimposed fashion. At the same time, the recording material P is electrostatically absorbed onto the transfer belt 200. Further, the recording material P to which the different color toner images were transferred is separated from the transfer belt 200 at a separation portion, and the separated recording material is sent to a fixing portion 9, where the toner image are fixed to the recording material. Thereafter, the recording material is discharged out of the apparatus as a recorded matter.

When image formation is performed under a low humidity environment, in some cases, image distortion such as a bird's foot print image is generated at the separation portion. That is to say, if a gap is generated between the transfer belt 200 and the recording material P at the separation portion to cause a peel discharge in the gap, the toner transferred to the recording material is scattered, thereby distorting the image.

In order to prevent the image distortion due to the discharge, a separation charge device 32 is used. A corona charger (charger of non-contact type) is used as the separation charge device 32 and is disposed in an opposed relation to a drive roller 210. AC voltage is applied to the separation charge device 32, thereby removing electricity from the recording material P and the transfer belt 200. By reducing potential of the recording material P and the transfer belt 200 by means of the separation charge device 32 to reduce intensity of an electric field in the gap, generation of the peel discharge is suppressed. By the removal of electricity, an electrostatic absorbing force of the recording material P to the transfer belt 200 is reduced, so that separation ability of the recording material P from the transfer belt 200 is stabilized and the peel discharge is relieved.

Further, since the drive roller 210 has low resistance, it is also used as a counter electrode for the separation charge device 32, and a conductive member having high coefficient of friction such as rubber is used for covering an outer surface of the drive roller 210.

However, when the scattered toner is adhered to the electrode of the corona charger, the performance of the charger is frequently worsened. In such a case, since the charger (performance of which was worsened) to which the toner was adhered must be exchanged, or a cleaner for cleaning the electrode of the charger must be provided, the entire apparatus is made more expensive.

SUMMARY OF THE INVENTION

An object of the present invention is to provide an image forming apparatus which can prevent poor image due to peel discharge generated when a recording material born on a recording material convey belt is separated from the recording material convey belt.

The other objects and features of the present invention will be apparent from the following detailed explanation of the invention referring to the accompanying drawings.

DETAILED DESCRIPTION OF THE PREFERRED EMBODIMENTS

The present invention will now be explained in connection with embodiments thereof with reference to the accompanying drawings.

First Embodiment

Figure 1:
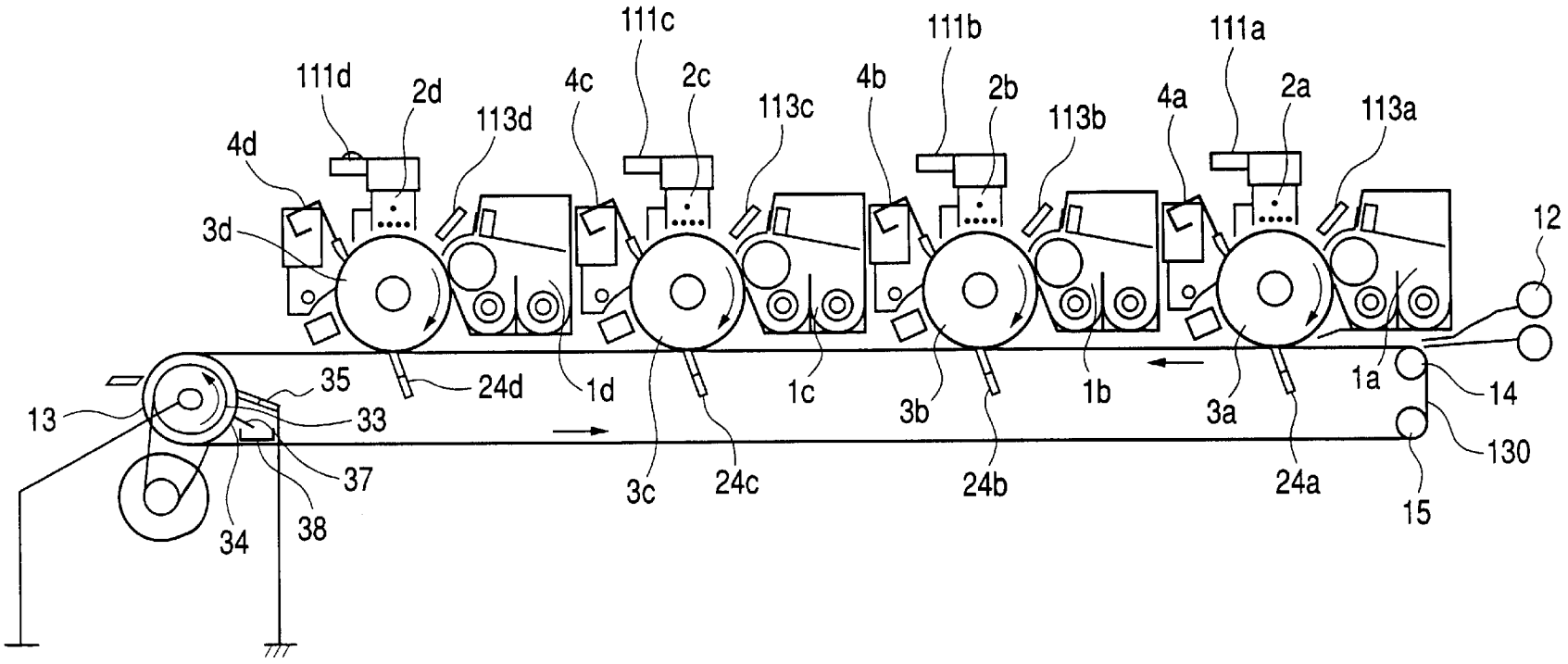
FIG. 1 is an explanatory view showing an image forming apparatus according to a first embodiment of the present invention.
Figure 9:
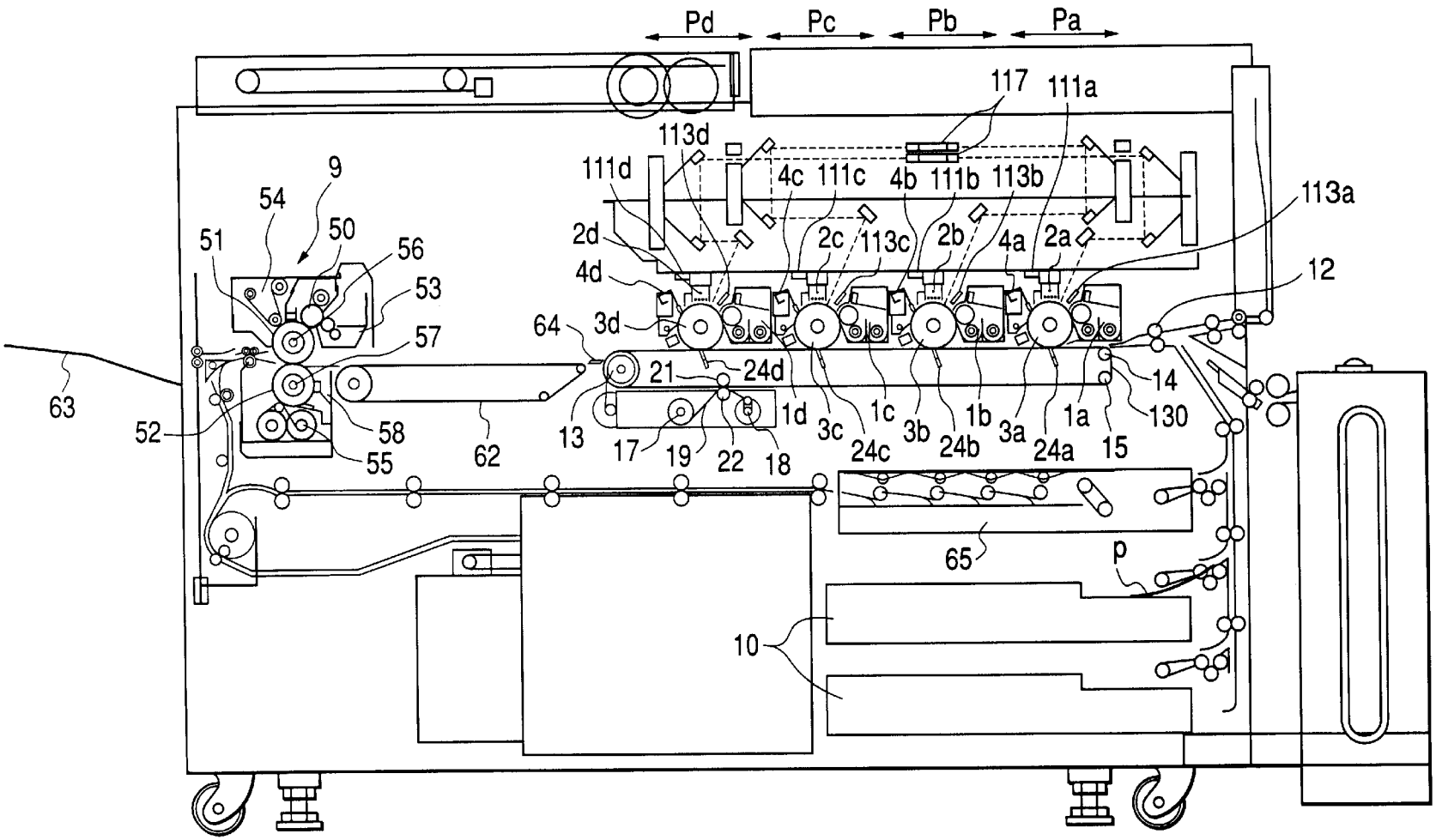
FIGS. 9 and 10 are explanatory views showing an image forming apparatus according to the present invention.
Figure 11:
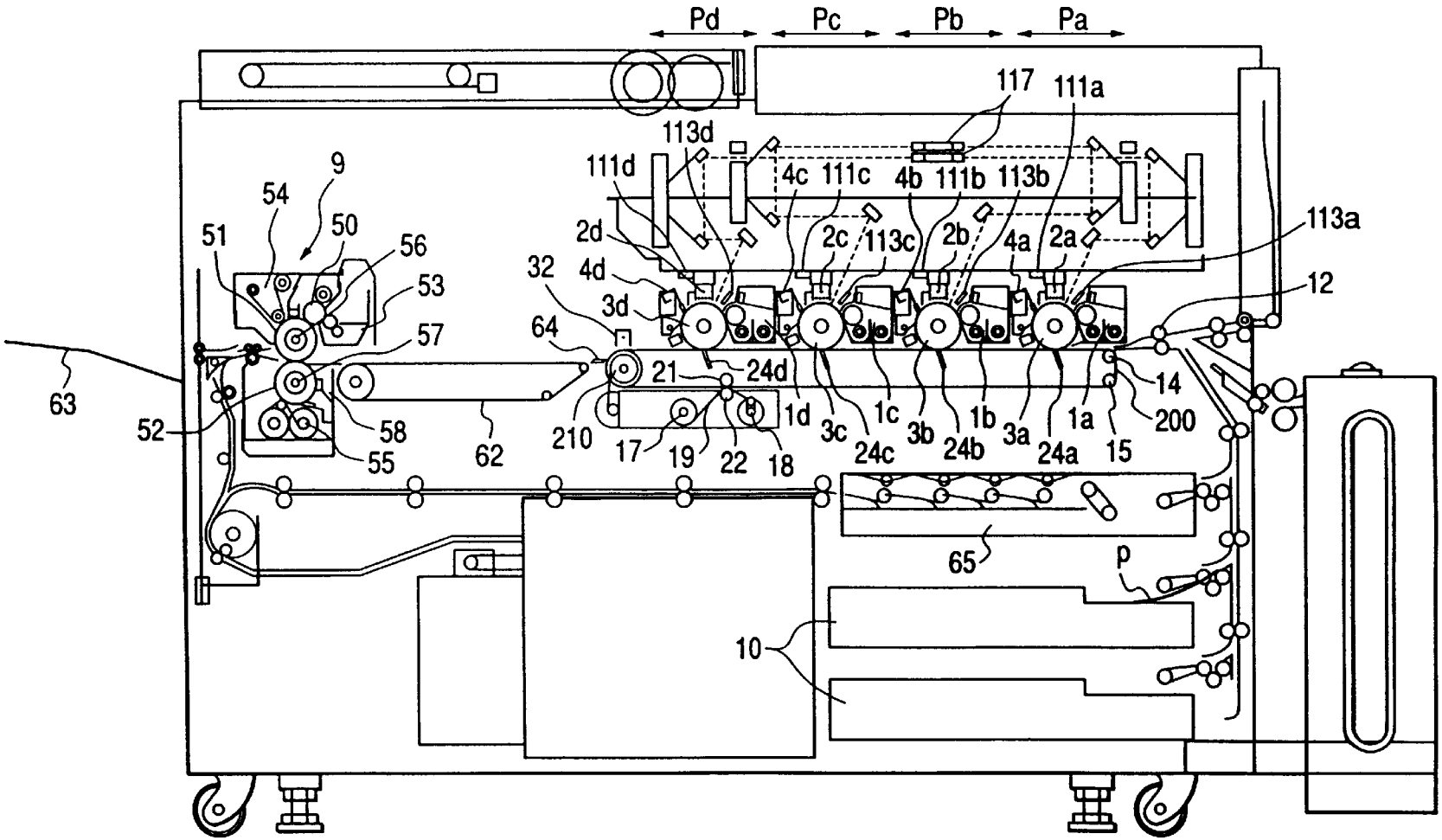
FIG. 11 PRIOR ART
FIG. 11 is an explanatory view showing a conventional image forming apparatus.

First of all, a first embodiment of the present invention will be described with reference to FIGS. 1 and 9, wherein the same elements as shown in FIG. 11 are designated by the same reference numerals.

Around photosensitive drums (image bearing members) 3*a*, 3*b*, 3*c* and 3*d*, there are disposed exposure lamps 111*a*,

111*b*, 111*c* and 111*d*; drum chargers 2*a*, 2*b*, 2*c* and 2*d*; potential sensors 113*a*, 113*b*, 113*c* and 113*d*; developing devices 1*a*, 1*b*, 1*c* and 1*d*; transfer chargers (transfer means) 24*a*, 24*b*, 24*c* and 24*d*; and cleaners 4*a*, 4*b*, 4*c* and 4*d*, respectively. And a light source device (not shown) and a polygon mirror 117 are disposed at an upper part of an image forming apparatus.

A laser beam emitted from the light source device is scanned by rotating the polygon mirror 117, and the scanned light is deflected by a reflection mirror and then is illuminated on generatrices of the photosensitive drums 3*a*, 3*b*, 3*c* and 3*d* (charged by the drum chargers 2*a*, 2*b*, 2*c* and 2*d*) through fθ lenses to expose the drums, thereby forming electrostatic latent images corresponding to image signals on the photosensitive drums 3*a* to 3*d*.

Predetermined amounts of cyan, magenta, yellow and black color toners are loaded in the developing devices, 1*a*, 1*b*, 1*c* and 1*d* via respective toner supplying devices. The developing devices 1*a*, 1*b*, 1*c* and 1*d* develop the latent images on the photosensitive drums 3*a*, 3*b*, 3*c* and 3*d* to form a cyan toner image, a magenta toner image, a yellow toner image and a black toner image, respectively.

Recording materials P are contained in a cassette 10 and are supplied one by one from the cassette by means of a plurality of convey rollers and a pair of regist rollers 12 to a transfer belt (recording material convey belt) 130. Then, the recording material is born by the transfer belt 130 and is successively passed through transfer portions opposed to the photosensitive drums 3*a*, 3*b*, 3*c* and 3*d*.

Further, the transfer belt 130 is formed from a dielectric sheet such as a polyethylene terephthalate resin (PET resin) sheet, a polyvinylidene fluoride sheet, a polyurethane resin sheet or a polyimide resin sheet, and both ends of the belt are butt-spliced to each other to form an endless loop, or a seamless belt is used. The transfer belt 130 is wound around and supported by a drive roller 13 and driven rollers 14, 15 in a tension condition. Volume resistivity of the transfer belt 130 is selected to $10^{12}$ to $10^{17}$ Ω·cm so that electrical interference does not occur between the image forming portions (for example, between Pa and Pb).

When it is ascertained that the transfer belt 130 is rotated and is located at a predetermined position, the recording material P is conveyed from the pair of regist rollers 12 to the transfer belt 130, so that the recording material P is conveyed toward the transfer portion of the first image forming portion Pa. At the same time, an image writing start signal is turned ON, and the toner image is formed on the photosensitive drum 3*a* of the first image forming portion Pa at a certain timing using the image writing start signal as a reference.

At the transfer portion below the photosensitive drum 3*a*, predetermined voltage is applied to the transfer charger 24*a*, so that the first color toner image formed on the photosensitive drum 3*a* is electrostatically transferred onto the recording material P. By this transferring charge, the recording material P is firmly held on the transfer belt 130 by an electrostatic absorbing force and then is conveyed to the second image forming portion Pb.

The formation and the transferring of the toner images at the second to fourth image forming portions Pb to Pd are effected in the similar manner to the first image forming portion Pa. Then, the recording material P to which fourth color toner images were transferred in a superimposed fashion is separated from a downstream end of the transfer belt 130 in a recording material conveying direction (curvature separation). The recording material P separated from the transfer belt 130 is conveyed to a fixing device 9 through a convey portion 62.

After the transferring, residual toners remaining on the photosensitive drums 3*a*, 3*b*, 3*c* and 3*d* are removed by the respective cleaners 4*a*, 4*b*, 4*c* and 4*d*, thereby preparing for next image formation. Residual toner and other foreign matter (paper powder and the like) remaining on the transfer belt 130 are scraped from the belt by abutting a cleaning web (non-woven fabric) 19.

The fixing device 9 is constituted by a fixing roller 51, a pressure roller 52, heat-resistive cleaning members 54, 55 for cleaning the rollers 51, 52, roller heating heaters 56, 57 disposed within the rollers 51, 52, a coating roller 50 for coating mold releasing oil such as dimethyl silicone oil to the fixing roller 51, and oil reservoir 53, and a thermistor 58 for controlling a fixing temperature by detecting a temperature of the surface of the pressure roller 52.

Regarding the recording material P to which the four color toner images were transferred, in the fixing device 9, the toner images are color-mixed and are fixed to the recording material P, thereby forming a full-color image. Thereafter, the recording material is discharged onto a discharge tray 63.

Next, the separation portion (separation position) for separating the recording material P from the transfer belt 130 will be fully described.

The drive roller 13 is constituted by a metallic support shaft roller (conductor which is grounded) 33, and an insulation layer 34 coated on an outer peripheral surface of the roller 33. A surface of the insulation layer 34 has high coefficient of friction to transmit a rotational driving force to the transfer belt 130, and a portion of the insulation layer is contacted with the transfer belt 130. When the drive roller 13 is rotated by a motor, the transfer belt 130 is rotated at a predetermined speed without generating slip between the drive roller and the transfer belt 130.

The insulation layer 34 is formed from urethane group rubber and has volume resistivity of, $10^{10}$, $10^{11}$, $10^{12}$, $10^{13}$, $10^{14}$, $10^{15}$ or $10^{16}$ Ω·cm. A diameter of the drive roller 13 including the insulation layer 34 is selected to 50 mm and a thickness for the insulation layer 34 is selected to 50 μm. In the illustrated embodiment, since volume resistivity of the support shaft roller 33 is substantially zero or is considerably smaller than the volume resistivity of the insulation layer 34, the volume resistivity of the support shaft roller is negligible. It is preferable that resistivity of the drive roller 13 in the thickness direction is $10^{10}$ to $10^{16}$ Ω·cm. Further, as a comparison example, a surface layer having volume resistivity of $10^{8}$ or $10^{9}$ Ω·cm and a metallic roller were used.

Further, the drive roller 13 also acts as a separation roller for separating the recording material P from the transfer belt 130. The transfer belt 130 is formed from polyimide resin and has volume resistivity ρv of $10^{12}$, $10^{13}$, $10^{14}$, $10^{15}$, $10^{16}$ or $10^{17}$ Ω·cm and a thickness of 100 μm.

The volume resistivity of the transfer belt 130 and the volume resistivity of the drive roller 13 can be measured in the following manner.

Voltage of 1 KV was applied and measurement was effected by using a high ohmmeter R8340A (manufactured by Advantest Inc.) and a probe R12702A (manufactured by Advantest Inc.). Incidentally, the measurement was performed under a normal environment (23° C., 60%) and was based upon JIS K6911.

An electricity removing member (electricity removal means) 35 is disposed on the outer peripheral surface of the drive roller 13 in such a manner that it is not contacted with the transfer belt 130, and is grounded. A conductive blade is used as the electricity removing member 35. The conductive blade abuts against the drive roller 13 along a tangential direction and is formed from an elongated plate-shaped conductive rubber member. By abutting the blade 35 against the drive roller along the tangential direction, the scraping of the insulation layer 34 of the drive roller 13 is prevented.

A dip sheet 37 is disposed below the conductive blade 35. The dip sheet 37 is made of PET (polyethylene terephthalate) and has a thickness of 30 $\mu$m and an penetrate amount of 0.2 mm. By providing the dip sheet 37, the matter scraped from the surface of the drive roller by the conductive blade 35 can be collected while preventing them from dropping downwardly. The dip sheet 37 may be made of urethane group material. A cleaner container 38 for containing the matter collected by the dip sheet 37 is disposed below the dip sheet 37.

Now, the reason why peel discharge can be reduced by the above-mentioned arrangement will be explained with reference to FIGS. 4 to 7.

Figure 4:
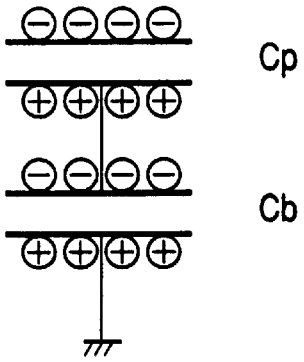
FIG. 4 PRIOR ART
FIG. 4 is an explanatory view showing charge model at a separation portion in a comparison example (immediately before separation)
Figure 5:
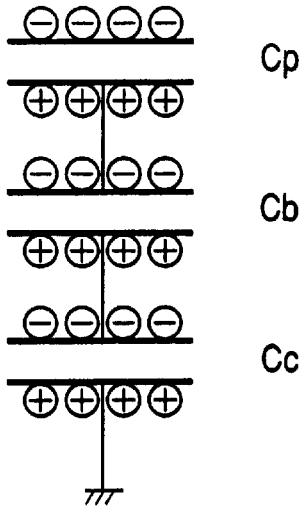
FIG. 5 is an explanatory view showing charge model at a separation portion in the present invention (immediately before separation)
Figure 6:
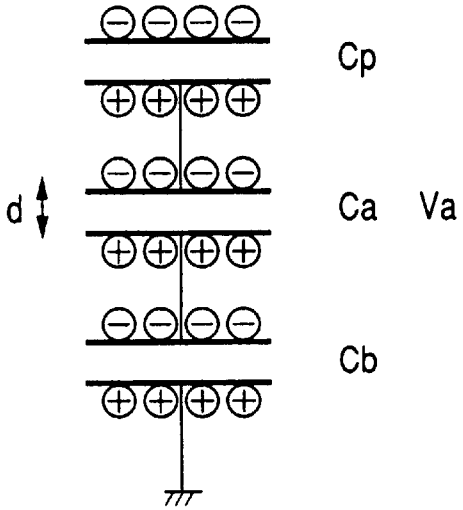
FIG. 6 PRIOR ART
FIG. 6 is an explanatory view showing charge model at a separation portion in the comparison example (immediately after separation)
Figure 7:
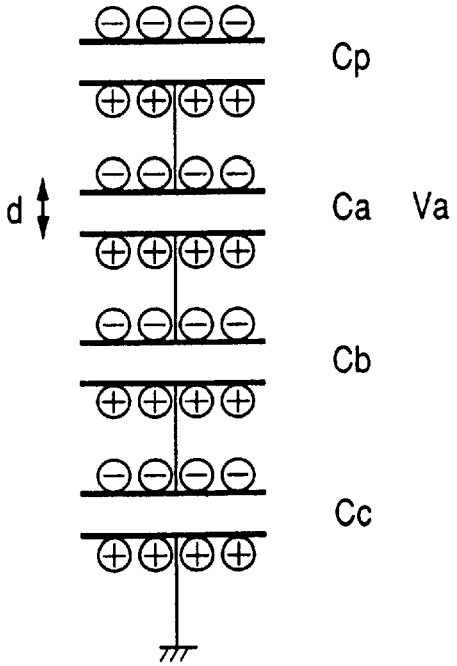
FIG. 7 is an explanatory view showing charge model at a separation portion in the present invention (immediately after separation)

FIGS. 4 and 6 are schematic views showing modeled charges in the comparison example, and FIGS. 5 and 7 are schematic views showing modeled charges in the illustrated embodiment. Charges having charge density $Q_0$ accumulated upon the transferring charge are uniformly distributed on the surface of the recording material P and the rear surface of the transfer belt 130 or the inside of the insulation layer 34 of the drive roller 13. In FIGS. 4 to 7, symbols Cp, Cb, Ca and Cc indicate electrostatic capacities (per unit area) of the recording material P, transfer belt 130, air gap (air layer between the recording material P and the transfer belt 130) and insulation layer 34 of the drive roller 13, respectively.

Further, FIGS. 4 and 5 are schematic views immediately before the recording material P is separated from the transfer belt 130, and FIGS. 6 and 7 are schematic views immediately after the recording material P was separated from the transfer belt 130. Conditions immediately before the separation shown in FIGS. 4 and 5 are changed to conditions immediately after the separation shown in FIGS. 6 and 7, respectively.

Due to the separation, an air layer (air gap) is generated between the recording material P and the transfer belt 130. Movement of the charges in the illustrated embodiment differs from movement of the charges in the comparison example, and it is considered that such difference creates difference in peel discharge.

As shown in FIG. 6, if the capacitor of the air layer is inserted between the capacitors of the recording material P and the transfer belt 130 charged as shown in FIG. 4, the charged density $Q_0$ is accumulated on the surface of the layer, thereby generating potential difference Va. After the separation, a distance between electrodes of the capacitor of the air layer is increased as the time goes on. When the thickness of the air layer becomes d, the potential difference Va of the air layer becomes as follows:

$$Va=Q_0 d/\epsilon_0 \quad (1)$$

When the potential difference Va exceeds the discharge start voltage, the peel discharge is generated. Here, $\epsilon_0$ indicates dielectric constant of vacuum (it is assumed that dielectric constant of air is substantially the same as $\epsilon_0$).

Figure 8:
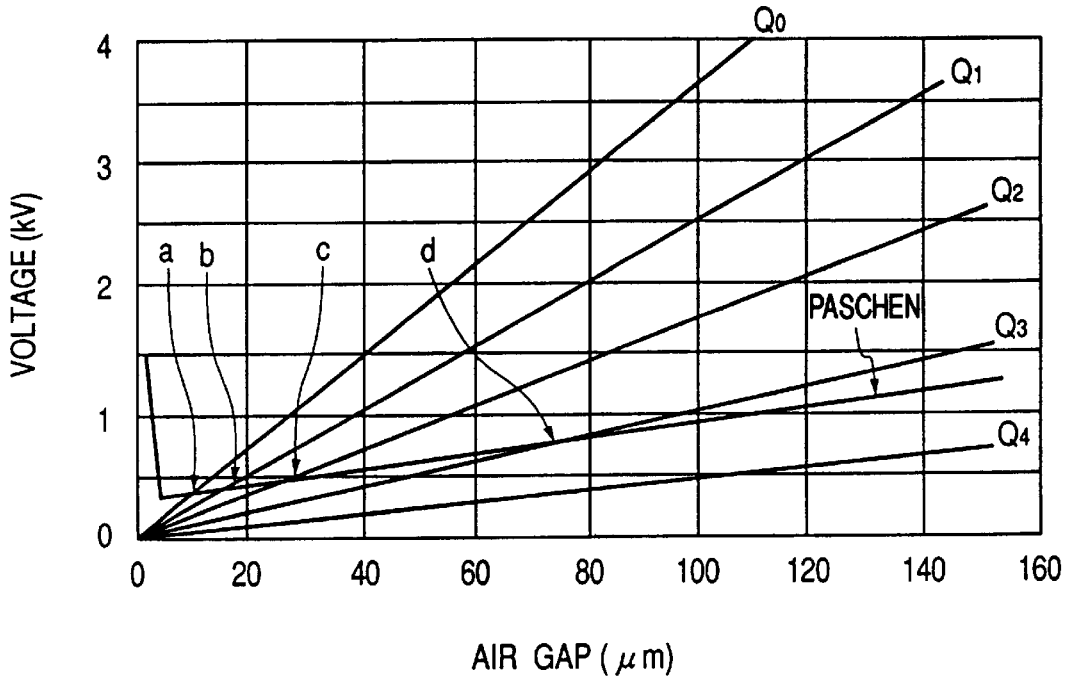
FIG. 8 is a graph showing a relation between discharge start voltage and an air gap.

Since the discharge start voltage depends upon only the distance between the electrodes under this condition in accordance with Paschen Law, when the relation between the potential difference (indicated by the above equation) and the thickness d of the air layer satisfies the relation of the Paschen Law, the peel discharge is generated. FIG. 8 is a graph showing the discharge start voltage according to the Paschen Law, regarding the potential difference Va and the air layer thickness d, when the thickness of the air layer in the above equation is changed.

In the graph shown in FIG. 8, when the recording material P is peeled from the transfer belt 130 up to the air gap distance corresponding to the intersection (a) between the Paschen Law and the above equation (1), the peel discharge is generated between the front surface of the transfer belt 130 and the rear surface of the recording material P.

By the way, in the above equation, inclination of increase is changed in accordance with magnitude of the charge density $Q_0$ accumulated before the separation. For example, when a process speed (rotational speed of the transfer belt 130) is 100 mm/sec and a width of the transfer belt 130 (in a direction perpendicular to the rotational direction of the belt) is 300 mm, if current of 10 $\mu$A enters into the above system, the charges having the following charge density $Q_0$ will be accumulated:

$$Q_0=3.3\times10^{-4}[C/m^2]$$

In this case, the discharge start voltage becomes about 10 KV. However, when the charge density $Q_0$ is decreased to $Q_1$, $Q_2$, $Q_3$ and $Q_4$, the inclination of the straight line becomes small, so that the intersection between the above equation and the Paschen Law is shifted accordingly.

At the intersection a, when the charge density $Q_0$ accumulated in the air gap is decreased to $Q_1$ by the peel discharge, the condition of the system is transferred from the straight line $Q_0$ to the straight line $Q_1$, so that the discharge is generated at a next intersection b by the peeling of the recording material P. By repeating such transitions, the charge density is decreased to $Q_4$, the peel discharge is not generated in the air gap. The above explanation is a mechanism of the peel discharge in the comparison example.

Next, movement of charges in the illustrated embodiment will be explained.

Also in the illustrated embodiment, due to the peeling of the recording material, the capacitor Ca of the air gap is inserted, so that the charges are accumulated between the electrodes, thereby generating the potential difference. However, unlike to the comparison example, since the capacitor Cc of the insulation layer 34 of the drive roller 13 is connected to the capacitor Cb of the transfer belt 130 in series, the discharge from the capacitor becomes small, so that the charges are apt to be discharged. Consequently, the charges accumulated in the capacitor are reduced more quickly.

That is to say, in the illustrated embodiment, the charge density $Q_0$ between the air gap is decreased to $Q_2$ due to the first peel discharge and then is decreased to $Q_4$ due to next peel discharge. Namely, the reduction of the charge density per one discharge is great in comparison with the comparison example, so that the number of peel discharges is greatly decreased, thereby reducing the image scattering due to the peel discharge.

However, in the illustrated embodiment, in FIGS. 4 to 7, it is considered that a closed circuit is formed on the recording material P by grounding via the air layer sufficiently greater than the air gap after the separation.

After the peeling, the charges are remained on the insulation layer 34 of the drive roller 13 in the accumulated condition. Accordingly, in a case where images are continuously formed on a plurality of recording material, if the driving is continued while being charged, upon the separation of the next recording material, the effect for reducing the peel discharge will be weakened. To avoid this, the charge on the insulation layer 34 of the drive roller 13 after the separation is dissipated since the electricity removing member 35 and the support shaft roller 33 are grounded.

Further, in the drive roller (its insulation layer 34 having volume resistivity of $10^{10}$ to $10^{16}$ Ω·cm) used in the illustrated embodiment, the above-mentioned effect could be obtained, but, in the drive roller (surface layer having volume resistivity of $10^{8}$, $10^{9}$ Ω·cm and metallic roller) in the comparison example, such effect could not be obtained. The volume resistivity of the insulation layer 34 of the drive roller is preferably $10^{10}$ to $10^{12}$ Ω·cm.

As mentioned above, by using the drive roller 13 coated by the insulation material and by grounding the support shaft roller (electricity removal means) and by grounding the conductive blade 35, the poor image can be reduced. When the images are continuously formed on a plurality of recording materials, more effective result can be achieved.

Further, in the illustrated embodiment, while an example that the support shaft roller 33 and the conductive blade (electricity removing member) 35 are always grounded was explained, electricity may be removed by applying AC voltage from an AC power source to at least one of these elements 33, 35. In this case, by providing a switch between the elements and the AC power source, the AC voltage may be applied to at least one of the support shaft roller 33 and the conductive blade 35 for a predetermined time period from a time when the separation of the recording material P from the transfer belt 130 is started to when the separation of the recording material is finished, and the portion of the drive roller contacted with the separation portion is shifted to a position where such a portion is contacted with the conductive blade 35.

When the images are continuously formed on a plurality of recording materials, during the time period between the preceding recording material passed through the separation portion and the succeeding recording material passed through the separation portion, the voltage may continue to be applied to facilitate the control.

Second Embodiment

Figure 2:
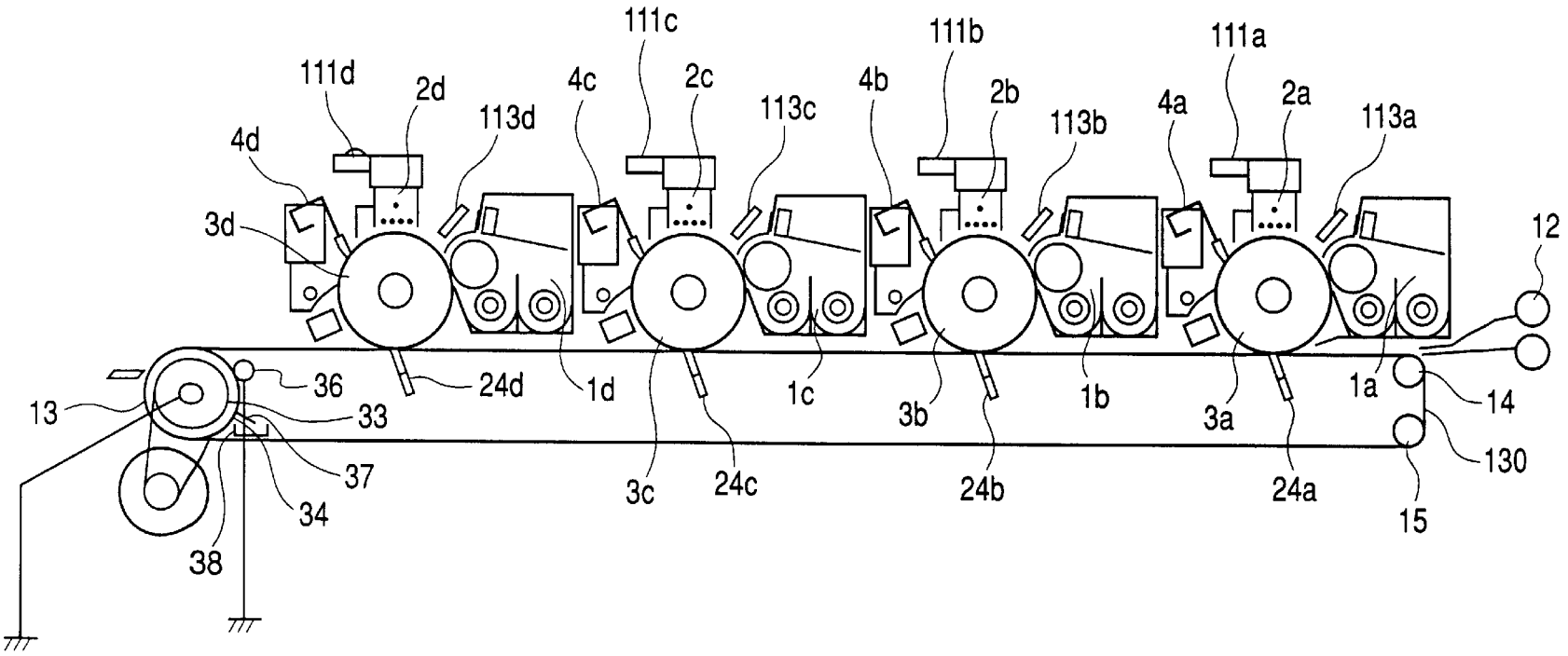
FIG. 2 is an explanatory view showing an image forming apparatus according to a second embodiment of the present invention.

Next, a second embodiment of the present invention will be explained with reference to FIG. 2.

In this second embodiment, the only difference from the first embodiment is that a metallic roller 36 is used as the electricity removing member. By using the metallic roller 36 as the electricity removing member, rotational load of the drive roller 13 can be reduced, thereby preventing uneven rotation of the transfer belt 130.

As mentioned above, by using the drive roller 13 coated by the insulation layer 34 and by using the support shaft roller 33 and the metallic roller (electricity removing member) 36, the poor image can be suppressed and the uneven rotational speed of the transfer belt can be prevented.

Third Embodiment

Next, a third embodiment of the present invention will be explained with reference to FIG. 3.

In this third embodiment, the only difference from the first embodiment is that a conductive brush 39 is used as the electricity removing member. By using the conductive brush 39 as the electricity removing member, rotational load of the drive roller 13 can be reduced, thereby preventing damage of the insulation layer 34. The conductive brush 39 is constituted by mounting conductive fibers having a length of 5 mm and volume resistivity of $10^{8}$ Ω·cm on a metal plate in a brush-shaped fashion with fiber density of $20000/cm^2$.

As mentioned above, by using the drive roller 13 coated by the insulation layer 34 and by using the support shaft roller 33 and the conductive brush (electricity removing member) 39, the poor image can be suppressed and the uneven rotational speed of the transfer belt can be prevented, and the damage of the insulation layer 34 can be prevented.

Incidentally, other than the electricity removing members explained in the first to third embodiments, a thin metal plate or an electricity removing probe of non-contact type may be used. Further, as described in connection with the first embodiment, if the adequate electricity removing effect cannot be achieved only by grounding the electricity removing member, the AC power source may be connected to the electricity removing member to apply a predetermined AC voltage to the electricity removing member. In this case, the predetermined AC voltage may also be applied to the support shaft roller 33 180° out of phase with the voltage applied to the electricity removing member, or, alternatively the AC power source may be connected to only the support shaft roller 33 and the electricity removing member may be grounded.

Further, in the illustrated embodiment, while an example that the drive roller 13 also acts to rotatingly drive the transfer belt 130 was explained, the present invention is not limited to such an example but, the drive roller 13 may have the function similar to that of the driven roller 14 or 15 in the illustrated embodiment.

The image bearing member is not limited to the electrophotographic photosensitive member but may be a dielectric body of electrostatic recording type.

The developing means 1*a* to 1*d* for developing the electrostatic latent images on the image bearing members 3*a* to 3*d* with toners can generally be grouped into four developing methods; i.e., a one-component non-contact developing method in which non-magnetic toner is coated on a sleeve by a blade and the like (or, magnetic toner is coated by a magnetic force) and the development is effected in a condition that the sleeve is not contacted with the image bearing member; a one-component contact developing method in which the development is effected in a condition that the sleeve is contacted with the image bearing member; a two-component contact developing method in which mixture of toner particles and magnetic carriers is used as developer and the developer is conveyed by a magnetic force and the development is effected in a condition that the sleeve is contacted with the image bearing member; and a two-component non-contact developing method in which the development is effected in a condition that the sleeve is not contacted with the image bearing member. In the present invention, any one of these methods can be used. The two-component contact developing method is preferable in view of high quality image and high stability of image.

Figure 3:
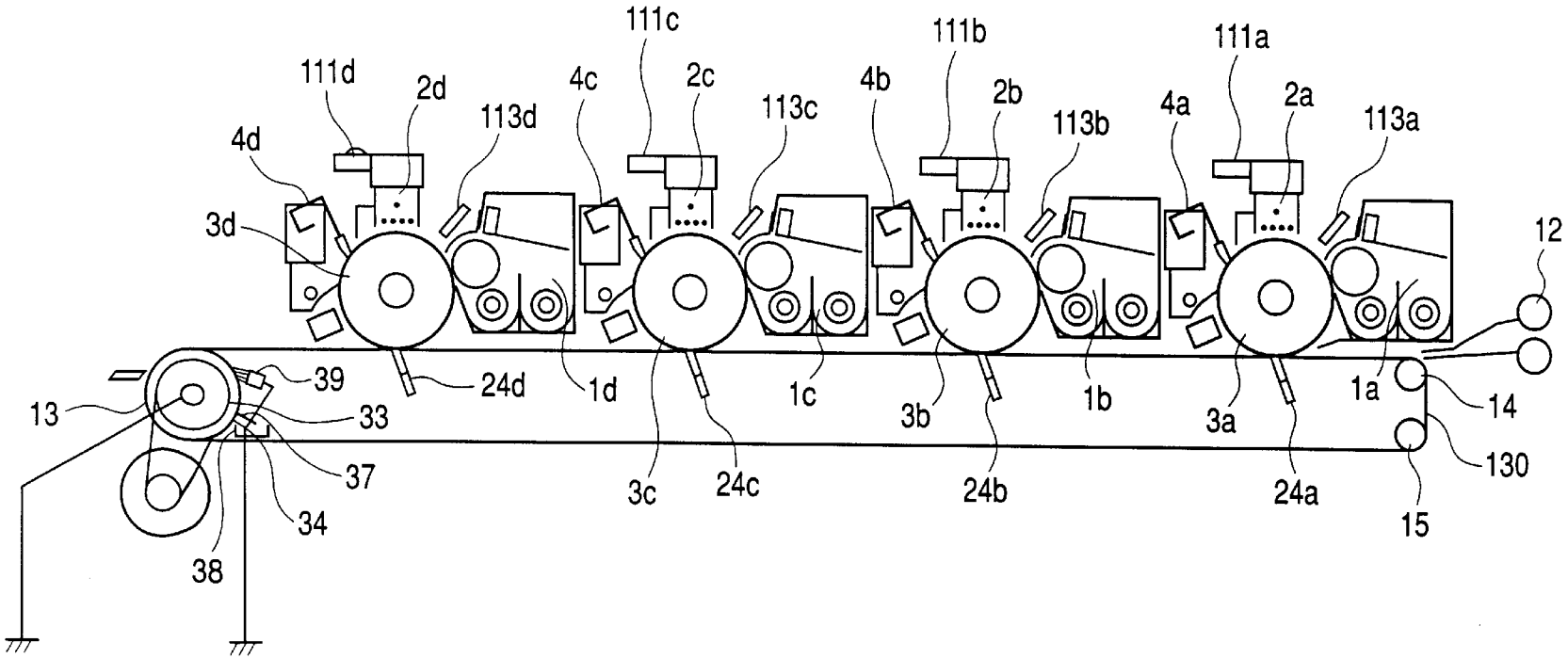
FIG. 3 is an explanatory view showing an image forming apparatus according to a third embodiment of the present invention.

In the illustrated embodiment, as shown in FIG. 3, while the image forming apparatus in which the toner image formed on the plurality of photosensitive drums are successively transferred onto the recording material borne on the transfer belt in a superimposed fashion was explained, the present invention is not limited to such an image forming apparatus, but, the present invention can be applied to image forming apparatuses having a single photosensitive drum.

Figure 10:
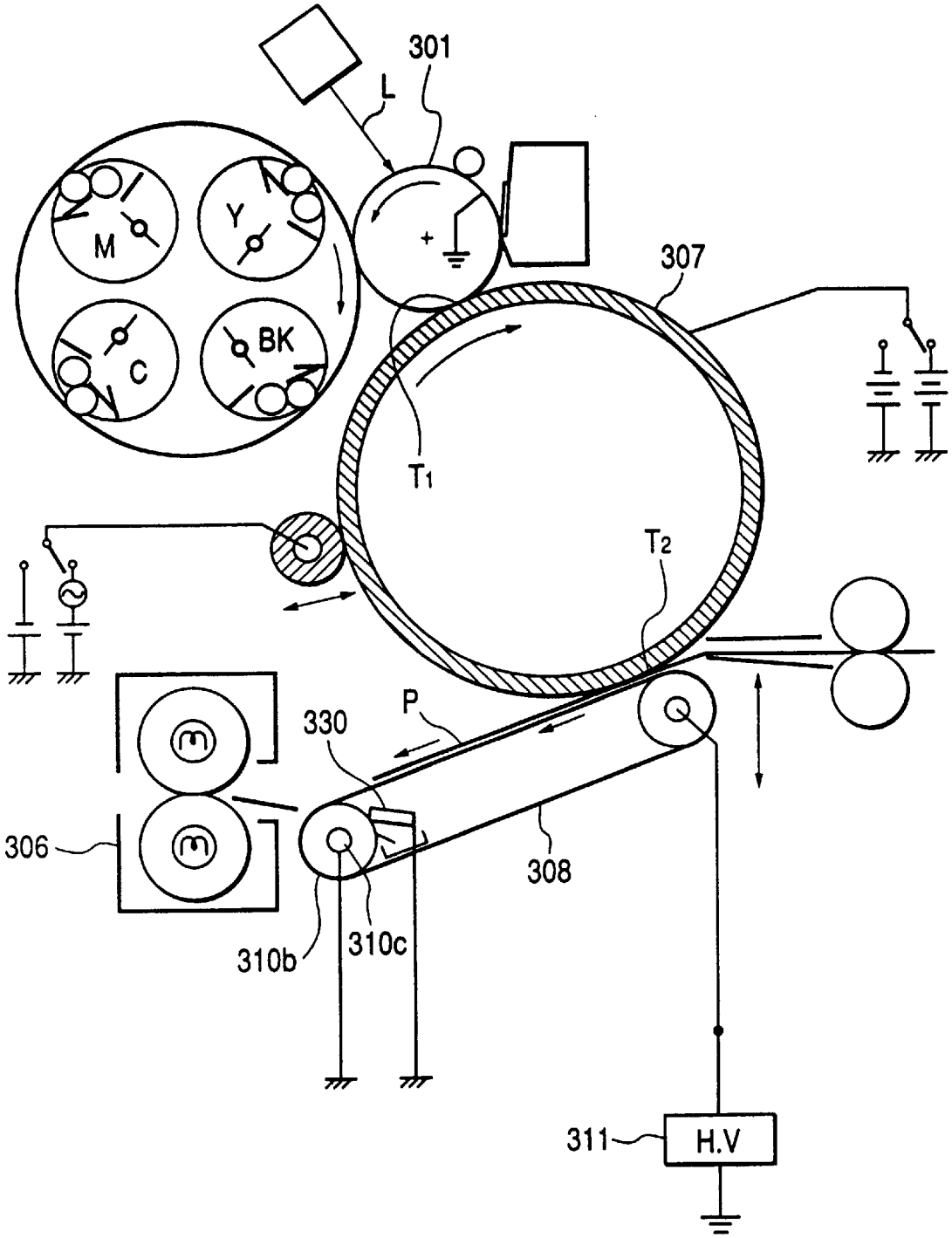

Further, the illustrated embodiment can be applied to an image forming apparatus as shown in FIG. 10. That is to say, a toner image formed on a photosensitive drum 301 is electrostatically transferred onto an intermediate transfer drum (intermediate transfer member) 307 at a first transfer position $T_1$. This operation is repeated by a desired number of times, and, the toner images transferred to the intermediate transfer drum 307 in a superimposed fashion are collectively and electrostatically transferred onto a recording material P conveyed to a second transfer position $T_2$ at a predetermined timing. The recording material P is separated from the intermediate transfer drum 307 by an electrostatic absorbing force to a transfer belt (recording material bearing member) 308 and is separated from the transfer belt 308 at a separation portion. Thereafter, toner images are fixed in a fixing device 306, and then, the recording material is discharged out of the apparatus.

In this case, the intermediate transfer drum 307, transfer belt 308, drive roller 310*b*, conductive blade (electricity removing member) 330 and support shaft roller 310*c* correspond to the photosensitive drum 1, transfer belt 130, drive roller 13, conductive blade 35 and support shaft roller 33, respectively.

Also, in such an image forming apparatus, the peel discharge at the separation portion can be suppressed and the poor image can be prevented.

What is claimed is:

1. An image forming apparatus comprising:

an image bearing member for bearing a toner image;

a recording material convey belt for bearing and conveying a recording material;

a roller for supporting said recording material convey belt and having an insulation layer; and an electricity removal means for removing electricity from said insulation layer, the toner image on said image bearing member being electrostatically transferred onto the recording material borne by said recording material convey belt, and said roller supports said recording material convey belt at a separation position where the recording material is separated from said recording material convey belt.

2. An image forming apparatus according to claim 1, wherein the volume resistivity of said insulation layer is $10^{10}$ to $10^{16}$ Ω·cm.

3. An image forming apparatus according to claim 1 or claim 2, wherein the volume resistivity of said recording material convey belt is $10^{12}$ to $10^{17}$ Ω·cm.

4. An image forming apparatus according to claim 1, wherein said roller has a conductive body disposed below said insulation layer.

5. An image forming apparatus according to claim 4, wherein said electricity removal means has a first electricity removing member for removing electricity from a front surface of said insulation layer, and a second electricity removing member for removing electricity from a rear surface of said insulation layer via said conductive body.

6. An image forming apparatus according to claim 5, wherein a first AC voltage is applied to said first electricity removing member.

7. An image forming apparatus according to claim 6, wherein the first AC voltage is applied to said first electricity removing member for a time period from when separation for the recording material from said recording material convey belt is started to when a predetermined time duration is elapsed after the separation.

8. An image forming apparatus according to claim 6 or 7, wherein said first electricity removing member is a conductive blade.

9. An image forming apparatus according to claim 6 or 7, wherein said first electricity removing member is a conductive roller.

10. An image forming apparatus according to claim 6 or 7, wherein said first electricity removing member is a conductive brush.

11. An image forming apparatus according to claim 6 or 7, wherein said second electricity removing member is grounded.

12. An image forming apparatus according to claim 6 or 7, wherein a second AC voltage is applied to said second electricity removing member.

13. An image forming apparatus according to claim 12, wherein the second AC voltage is applied to said second electricity removing member for a time period from when separation of the recording material from said recording material convey belt is started to when a predetermined time duration is elapsed after the separation.

14. An image forming apparatus according to claim 13, wherein the first AC voltage and the second AC voltage are 180° out of phase from each other.

15. An image forming apparatus according to claim 5, wherein said first electricity removing member is grounded.

16. An image forming apparatus according to claim 15, wherein said first electricity removing member is a conductive blade.

17. An image forming apparatus according to claim 15, wherein said first electricity removing member is a conductive roller.

18. An image forming apparatus according to claim 15, wherein said first electricity removing member is a conductive brush.

19. An image forming apparatus according to claim 15, wherein said second electricity removing member is grounded.

20. An image forming apparatus according to claim 15, wherein a second AC voltage is applied to said second electricity removing member.

21. An image forming apparatus according to claim 20, wherein the second AC voltage is applied to said second electricity removing member for a time period from when separation of the recording material from said recording material convey belt is started to when a predetermined time duration is elapsed after the separation.

22. An image forming apparatus according to claim 1, wherein the image forming apparatus comprises a plurality of image bearing members for bearing a plurality of color toner images, and the plurality of color toner images on said plurality of image bearing members are electrostatically transferred onto the recording material born by said recording material convey belt successively in a superimposed fashion.

23. An image forming apparatus according to claim 1, wherein the image forming apparatus has a photosensitive member on which a toner image is formed, and the toner image on said photosensitive member is transferred onto said image bearing member.

* * * * *

UNITED STATES PATENT AND TRADEMARK OFFICE

CERTIFICATE OF CORRECTION

PATENT NO. : 6,128,460
DATED : October 3, 2000
INVENTOR(S) : Ito et al.

It is certified that error appears in the above-identified patent and that said Letters Patent is hereby corrected as shown below:

Column 2:
Line 15, "born" should read -- borne -- .

Column 4:
Line 46, "resistivity" should read -- the resistivity -- .

Column 5:
Line 66, "with" should read -- with the -- .

Column 6:
Line 25, "KV." should read -- kV. --; and
Line 64, "are remained" should read -- remain --.

Column 8:
Line 19, "33" should read -- 33, --; and
Line 20, "alternatively" should read -- alternatively, --.

Column 10:
Line 53, "born" should read -- borne --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*